US006384801B1

(12) United States Patent
Takahashi

(10) Patent No.: US 6,384,801 B1
(45) Date of Patent: May 7, 2002

(54) INFORMATION DISPLAY SYSTEM AND INFORMATION DISPLAY METHOD

(75) Inventor: Kiyoshi Takahashi, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/506,536

(22) Filed: Feb. 17, 2000

(30) Foreign Application Priority Data

Feb. 19, 1999 (JP) ..... 11-041458

(51) Int. Cl.[7] ..... G06G 5/00
(52) U.S. Cl. ..... 345/1.1; 345/1.3; 345/2.1
(58) Field of Search ..... 345/1.1, 1.3, 2.1, 345/2.2, 4; 296/21; 104/53, 55, 84

(56) References Cited

U.S. PATENT DOCUMENTS 4,019,773 A * 4/1977 Vehling ..... 296/21
5,266,930 A * 11/1993 Ichikawa et al. ..... 345/8
5,704,836 A * 1/1998 Norton et al. ..... 463/36
6,047,809 A * 4/2000 Idetsuki ..... 198/337
6,098,549 A * 8/2000 Mares ..... 104/76
6,141,123 A * 10/2000 Nakashima et al. ..... 359/3

* cited by examiner

*Primary Examiner*—Bipin Shalwala
*Assistant Examiner*—Jeff Piziali
(74) *Attorney, Agent, or Firm*—Frommer Lawrence & Haug LLP; William S. Frommer

(57) ABSTRACT

A velocity detector detects the velocity of a person moving along a predetermined path. A controller controls information display programs of image servers adapted for sending a series of information to a plurality of image display devices arranged sequentially along the path in accordance with the detected velocity of the moving person. The image display devices share with each other in displaying a series of information as a message. Each of the image display devices display a part of the series of information that is recognizable by the moving person according to the information display program. Thus, information can surely be presented to a person moving along a predetermined path, and no expensive large-size display screen is required.

11 Claims, 14 Drawing Sheets

PLAYLIST (P0)

LENGTH OF ZONE WHERE NO IMAGE IS VIEWABLE : $e_0$

DISTANCE BETWEEN IMAGE DISPLAY DEVICES : $d_0$

| TRANSMISSION START TIME (hh:mm:ss:ff) | EVENT ID | PROGRAM LENGTH (hh:mm:ss: |
|---|---|---|
| Y00 | EVENT0 | D0 |
| Y01=Y00+D0 | EVENT1 | D1 |
| Y02=Y01+D1 | EVENT2 | D2 |
| Y03=Y02+D2 | EVENT3 | D3 |
| ⋮ | ⋮ | ⋮ |
| Y0q= Y0q-1+Dq-1 | EVENTq | Dq |

PLAYLIST (P1)

LENGTH OF ZONE WHERE NO IMAGE IS VIEWABLE : $e_1$

DISTANCE BETWEEN IMAGE DISPLAY DEVICES : $d_1$

| TRANSMISSION START TIME (hh:mm:ss:ff) | EVENT ID | PROGRAM LENGTH (hh:mm:ss:ff) |
|---|---|---|
| Y10=Y00+ d1/v0+e1/v0 | EVENT0 | D0 |
| Y11=Y01+ d1/v1+e1/v1 | EVENT1 | D1 |
| Y12=Y02+ d1/v1+e1/v1 | EVENT2 | D2 |
| Y13=Y03+ d1/v1+e1/v1 | EVENT3 | D3 |
| ⋮ | ⋮ | ⋮ |
| Y1q=Y0q-1+ d1/v1+e1/v1 | EVENTq | Dq |

PLAYLIST (Pn)

LENGTH OF ZONE WHERE NO IMAGE IS VIEWABLE : $e_n$

DISTANCE BETWEEN IMAGE DISPLAY DEVICES : $d_n$

| TRANSMISSION START TIME (hh:mm:ss:ff) | EVENT ID | PROGRAM LENGTH (hh:mm:ss:ff) |
|---|---|---|
| Yn0=Yn0+ dn/v0+en/v0 | EVENT0 | D0 |
| Yn1=Yn1+ dn/v1+en/v1 | EVENT1 | D1 |
| Yn2=Yn2+ dn/v1+en/v1 | EVENT2 | D2 |
| Yn3=Yn3+ dn/v1+en/v1 | EVENT3 | D3 |
| ⋮ | ⋮ | ⋮ |
| Ynq=Ynq-1+ dn/v1+en/v1 | EVENTq | Dq |

FIG.3

PLAYLIST (P0)

LENGTH OF ZONE WHERE NO IMAGE IS VIEWABLE : $e_0$

DISTANCE BETWEEN IMAGE DISPLAY DEVICES : $d_0$

| TRANSMISSION START TIME (hh:mm:ss:ff) | EVENT ID | PROGRAM LENGTH (hh:mm:ss:ff) |
|---|---|---|
| Y00 | EVENT0 | D0 |
| Y01=Y00+D0 | EVENT1 | D1 |
| Y02=Y01+D1 | EVENT2 | D2 |
| Y03=Y02+D2 | EVENT3 | D3 |
| ⋮ | ⋮ | ⋮ |
| Y0q= Y0q-1+Dq-1 | EVENTq | Dq |

PLAYLIST (P1)

LENGTH OF ZONE WHERE NO IMAGE IS VIEWABLE : $e_1$

DISTANCE BETWEEN IMAGE DISPLAY DEVICES : $d_1$

| TRANSMISSION START TIME (hh:mm:ss:ff) | EVENT ID | PROGRAM LENGTH (hh:mm:ss:ff) |
|---|---|---|
| Y10=Y00+e1/v0 | EVENT0 | D0 |
| Y11=Y01+e1/v1 | EVENT1 | D1 |
| Y12=Y02+e1/v1 | EVENT2 | D2 |
| Y13=Y03+e1/v1 | EVENT3 | D3 |
| ⋮ | ⋮ | ⋮ |
| Y1q= Y0q-1+e1/v1 | EVENTq | Dq |

PLAYLIST (Pn)

LENGTH OF ZONE WHERE NO IMAGE IS VIEWABLE : $e_n$

DISTANCE BETWEEN IMAGE DISPLAY DEVICES : $d_n$

| TRANSMISSION START TIME (hh:mm:ss:ff) | EVENT ID | PROGRAM LENGTH (hh:mm:ss:ff) |
|---|---|---|
| Yn0=Yn0+en/v0 | EVENT0 | D0 |
| Yn1=Yn1+en/v1 | EVENT1 | D1 |
| Yn2=Yn2+en/v1 | EVENT2 | D2 |
| Yn3=Yn3+en/v1 | EVENT3 | D3 |
| ⋮ | ⋮ | ⋮ |
| Ynq= Ynq-1+en/v1 | EVENTq | Dq |

FIG.4

INFORMATION DISPLAY SYSTEM AND INFORMATION DISPLAY METHOD

BACKGROUND OF THE INVENTION

1. Field of the Invention

The present invention relates to an information display system and an information display method for presenting information to a person moving along a predetermined path.

2. Description of the Related Art

There has been proposed an information display device, such as an electric signboard, for displaying a message with images or letters to a person who is moving on a moving walk, an escalator or a vehicle. The information displayed on the device should be read and understood in a short period of time before the moving person passes by the device. To this end, the information display device is designed to have such a large display screen that the message displayed thereon can definitely be read and understood by the moving person at a remote position. Such a large size of the display screen will lead to a substantially increased display time for which the moving person can read the message from the beginning to the end. Further, the message is edited so concise that such a moving person can surely read it in a limited length of time.

As mentioned above, with the conventional information display device for displaying a message with images or letters to a person who is moving on a moving walk, an escalator or a vehicle, there is raised a problem that the display screen should be designed large and the manufacturing cots will be larger proportionally to the increased size of the display screen.

Also, there is another problem that the edition of a message to be concise for ready understanding needs a long time and much labor. Not all the messages thus prepared can precisely be understood as the case may be.

OBJECT AND SUMMARY OF THE INVENTION

It is therefore an object of the present invention to overcome the above-mentioned drawbacks by providing an information display system and an information display method, adapted to positively present information to a person moving along a predetermined path without the need of using any large display screen.

According to the present invention, there is provided an information display system including:

a plurality of information display means arranged one after another along a predetermined path for persons to whom the information is to be presented;

an information sending means for sending information to the plurality of information display means under an information display program; and a control means for controlling the information display program of the information sending means in accordance with a velocity of the person moving along the path;

the information display means sharing with each other in displaying a series of information under the information display program, each being adapted to display a part of the series of information that is readily recognizable by the moving person.

According to the present invention, there is also provided an information display method including the steps of:

detecting the velocity of a person moving along a predetermined path along which a plurality of information display means is arranged one after another;

controlling an information display program in accordance with the detected velocity of the person; and displaying, under the information display program, a series of information by the plurality of information display means sharing with each other in the displaying, each of the information display means being adapted to display a part of the series of information that is readily recognizable by the moving person.

According to the present invention, a plurality of information display means arranged one after another along a path shares with each other in displaying a series of information under the information display program, each being adapted to display a part of the series of information that is readily recognizable by the moving person. Even a message too long for one of the information display means to display only by itself can thus be presented to the moving person by two or more of the information display means without the necessary of stopping the moving person.

Further, since the information display program is controlled in accordance with a velocity of the person moving along the path, the message can surely be presented to the moving person.

Furthermore, a series of information is divided depending upon a velocity of the moving person for sequential display on the plurality of the information display means. Thus, the information can surely be presented to the person moving along the predetermined path, and no large display screen is required for display of the series of information. As mentioned above, too long a message for one of the information display means to cover by itself can be presented to the moving person by two or more of the information display means.

Moreover, since the present invention requires no expensive large-size display screen, it can provide a high economic-efficiency display system using a plurality of information display means each having an inexpensive small-size display screen.

Also, since the present invention uses the means for transmitting information stored in the information storage means under the information display program, it contributes to a considerable reduction of the costs and labor required for the hardware and media by which the transmitting means and message materials are set up for each display.

These objects and other objects, features and advantages of the present intention will become more apparent from the following detailed description of the preferred embodiments of the present invention when taken in conjunction with the accompanying drawings.

BRIEF DESCRIPTION OF THE DRAWINGS

FIG. 3 is an example of playlist generated, when in a program repeat mode, by a controller in the information display system;

FIG. 4 is an example of playlist generated, when in a continuous send mode, by the controller;

DETAILED DESCRIPTION OF THE PREFERRED EMBODIMENTS

Figure 1:
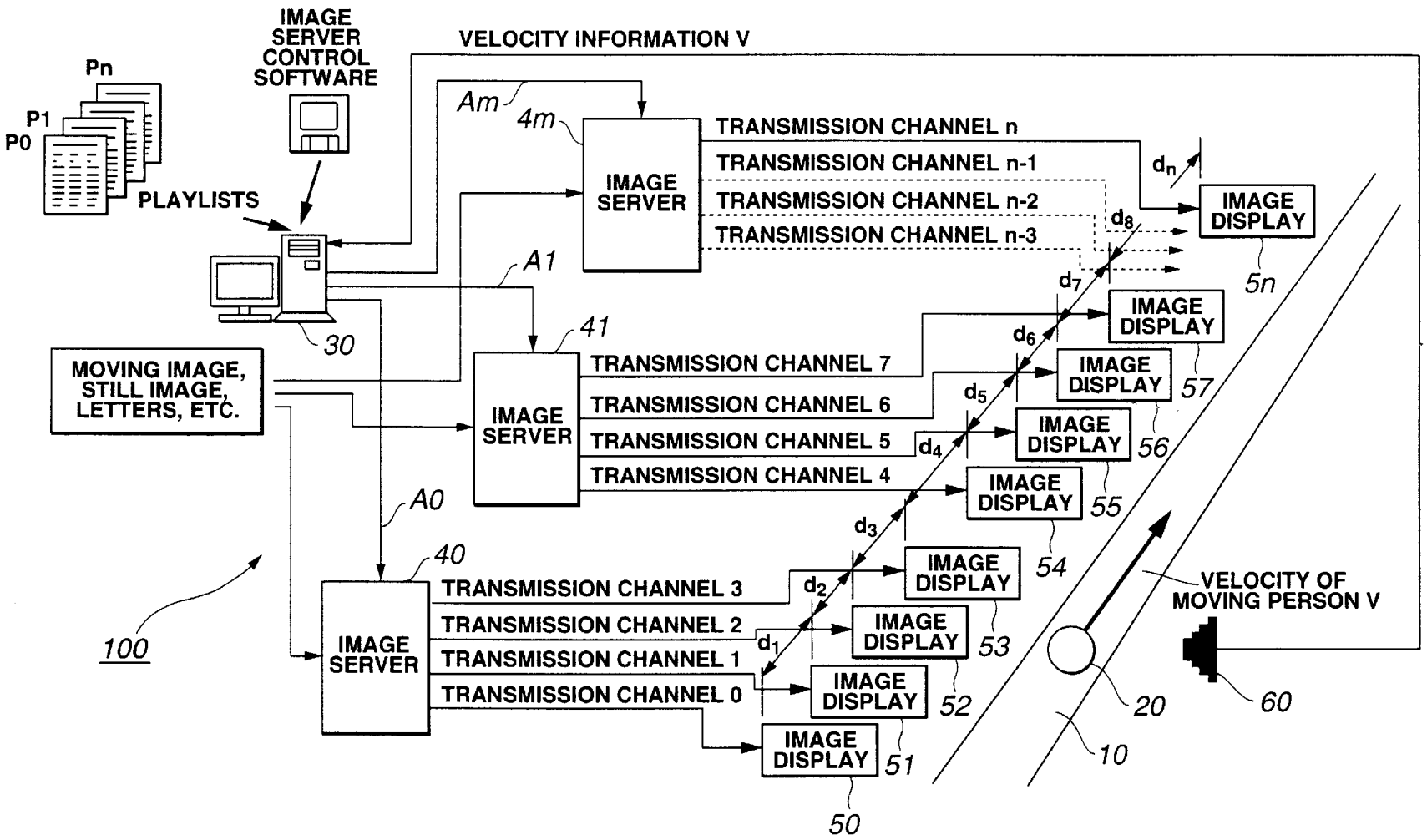
FIG. 1 is a conceptual view of an information display system according to the present invention.

The present invention provides, for example, an information display system indicated generally with a reference 100 in FIG. 1. The information display system 100 is to present information to persons, for example, a person 20 on a moving walk, an escalator or a vehicle, which is moving along a predetermined path 10. The information display system 100 includes a plurality of image servers 40, 41, . . . , 4*m* controlled by a controller 30, a plurality of image display devices 50, 51, . . . , 5*n* which are supplied with information from the image servers 40, 41, . . . , 4*m*, and a velocity detector 60 which detects a velocity of the person 20 moving along the path 10.

The controller 30 is a personal computer with a communication facility and having control lines (RS-232C or RS-422) A0, A1, . . . , Am connected to communication ports thereof. Thus the controller 30 controls the image servers 40, 41, . . . , 4*m* via the control lines A0, A1, . . . , A*m*. The controller 30 has installed therein a software for controlling the image servers 40, 41, . . . , 41*m*.

Figure 2:
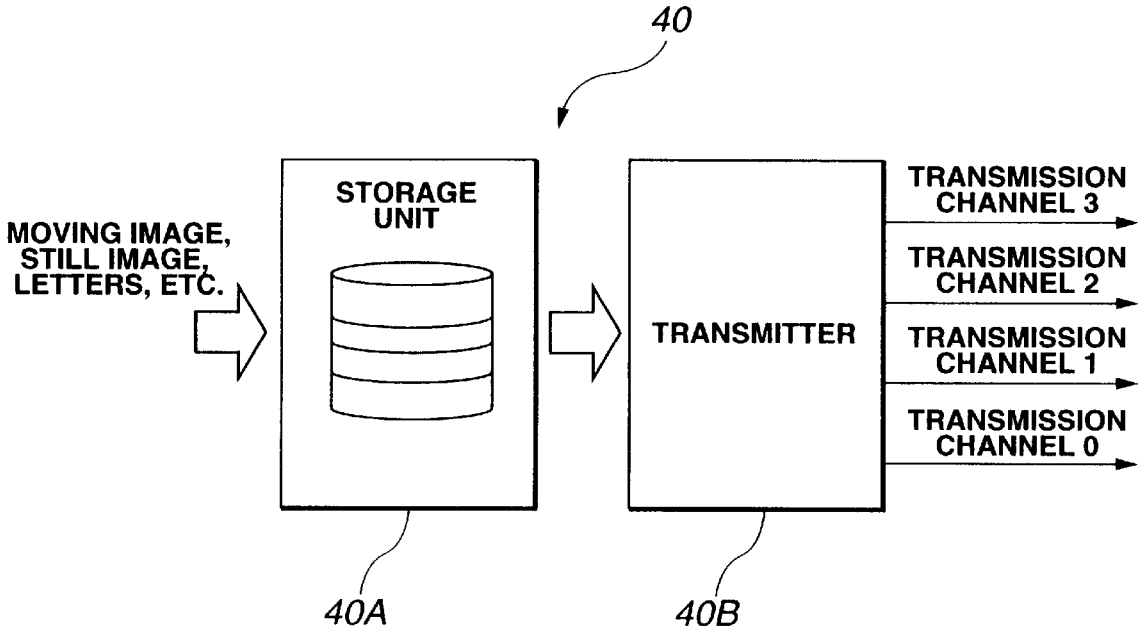
FIG. 2 is a block diagram of an image server included in the information display system.

As shown in FIG. 2, the image server 40 includes a storage unit 40A formed from, for example, a hard disc array for storing message materials such as a moving image, still image and letters, and a transmitter 40B for sending the message materials read out from the storage unit 40A to a plurality of sending channels. The image server 40 is controlled by the controller 30 according to the image server controlling software. The image server 40 is adapted to store the message materials in the storage unit 40A while sending different program materials, which may contain more than one same material, over a number g (four herein) of channels simultaneously from the transmitter 40B. The other image servers 41, 42, . . . , 4*m* are adapted similarly to the image server 40.

The image display devices 50, 51, . . . , 5*n* are disposed one after another along the path 10 at intervals d1, d2, . . . , d*n* between them. In the information display system 100, the image display devices 50, 51, . . . , S*n* can be relocated by carrying devices (not shown) . The controller 30 controls the carrying devices to move the interval between the image display devices for varying the intervals between them.

Further, the velocity detector 60 is provided to detect the average velocity of each or a mass of the persons 20 moving along the predetermined path 10. As this velocity detector 60, a well-known detector such as an ultrasonic velocity detector is used. The velocity detector 60 provides the controller 30 with velocity information v indicative of an average velocity of the moving persons 20.

From the velocity information v provided from the velocity detector 60 and the intervals d1, d2, . . . , d*n* of the image display devices 50, 51, . . . , 5*n*, the controller 30 calculates, for example, a time at which each of the image display devices 50, 51, . . . , 5*n* comes into sight of the person 20, and controls information display programs of the image servers 40, 41, . . . , 4*m* to have the image display devices 50, 51, . . . , 5*n* share with each other in displaying a series of information, that is, the controller 30 controls each of the image display devices to display a part of the series of information that is readily recognizable by the moving person.

For example, the controller 30 determines, from the calculated time, a delay in start of the playlist from one image display device to a next one, and has the information display programs executed by the image servers 40, 41, . . . , 4*m*, respectively, in accordance with their own playlists. More specifically, for example, in order to present a message having a length of t seconds to the person 20 moving at a velocity v, which requires a succession of four equidistantly disposed image display devices, the start of the message display is delayed in the playlists of the image display devices by t/4 of a second so that the person 20 can read the message displayed over the four successive image display devices.

The playlist lists when to read out and send messages stored in storage units of the image servers 40, 41, . . . , 4*m*. It is generated by the controller 30 as will be described below.

That is, for generating playlists P0, P1, . . . , Pn for the image display devices 50, 51, . . . , 5*n*, a playlist master as the core of each of the playlists P0, P1, . . . , Pn is generated first of all.

To generate the playlist master, there is first generated a list in which IDs (Events 0, 1, . . . , q) of events (programs) to be transmitted, addresses in the image server where the event IDs are stored and lengths (D0, 1, . . . , q) of the events (program) are arranged in the order of transmission. Then, a time (Y00) at which the transmission of the first event (Event 0) is to be started is designated to determine a next start time (Y01) as in the following:

$$Y01=Y00+D0$$

That is, the program length (D0) is added to the transmission start time (Y00) for the first event (Event 0) to determine the transmission start time (Y01) for the next event (Event 1). Subsequently, this procedure is repeated to calculate transmission start points of time (Y02, . . . , 0*q*) for the third event (Event 2) to last event (Event q), respectively. Note that the transmission start points of time (Y01, 02, . . . , 0*q*) for, and the program lengths (D0, 1, . . . , q) of, the respective events are shown in the form of hour (hh): minute (mm): second (ss): frame (ff).

The playlist master becomes the playlist P0 of the image display device 50 which is installed at the start point as shown in FIGS. 3 and 4.

In case the image display devices 50, 51, . . . , 5*n* arranged one after another along the path 10 come serially into sight of the person 20 moving along the path 10, a program can be transmitted from one transmitter to all the image display devices in a sequence programmed in the playlist master PM to divide even an event (program) which cannot be displayed in a single zone (d) from one image display device to a next one into pieces for the respective image display devices, thereby permitting to present an intended message to the person 20.

Figure 5:
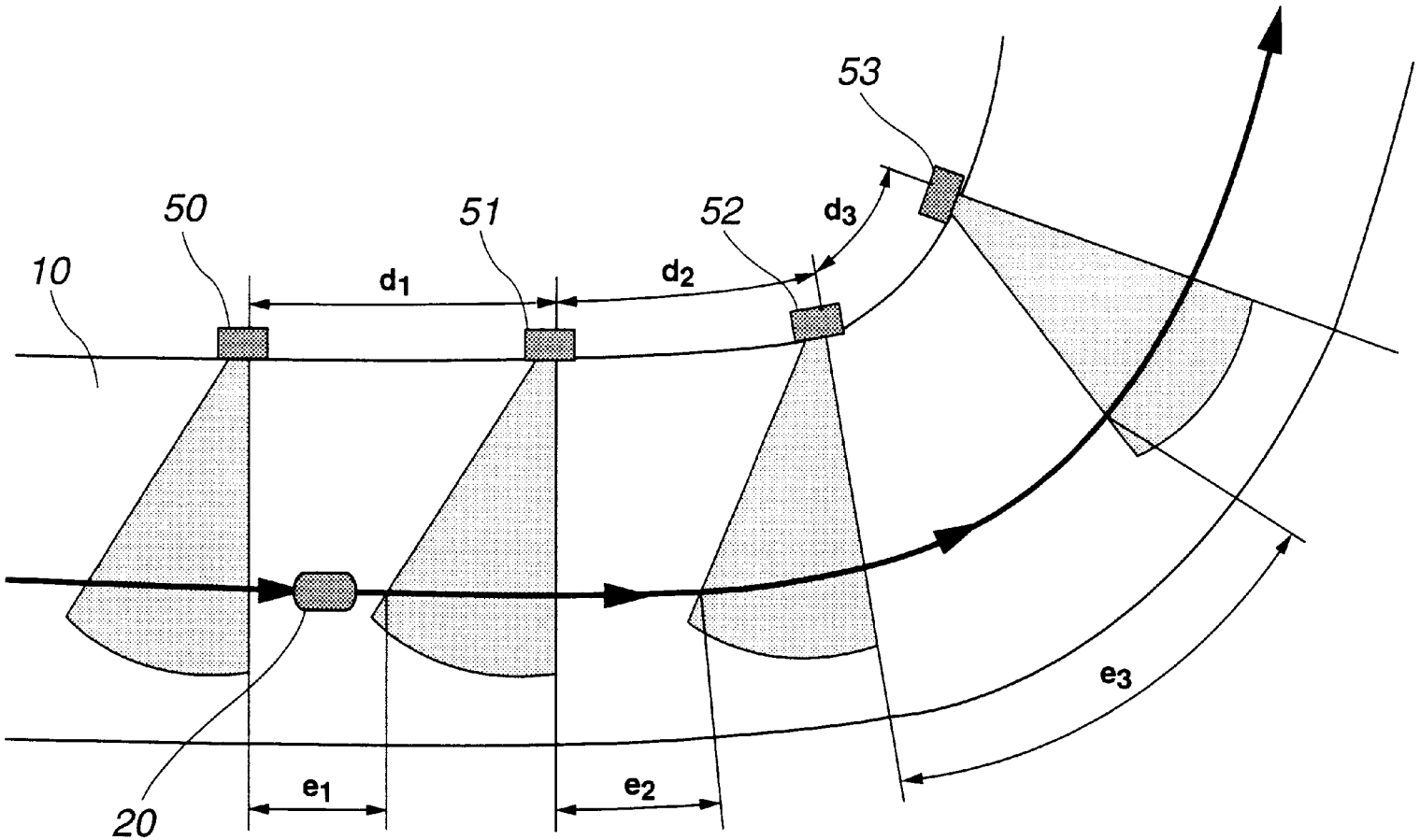
FIG. 5 schematically illustrates an example of the installed image display devices in the information display system.
Figure 6:
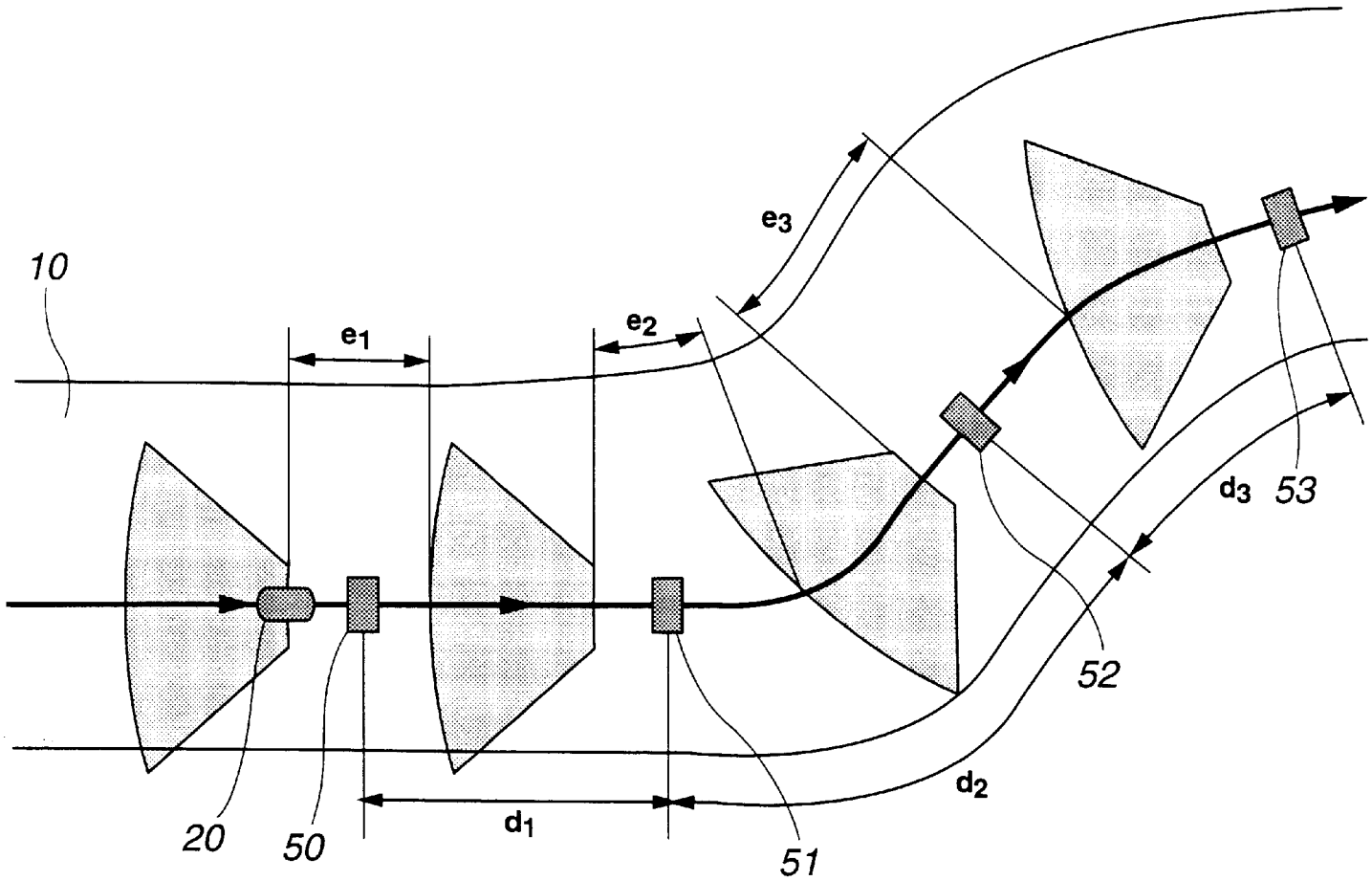
FIG. 6 is a schematic view of another example of the installed image display devices.

On the other hand, in case that because of the angles of installation of the image display devices 50, 51, . . . , 5*n* installed along a predetermined path as well as of the angles of viewing of the person 20 relative to the image display devices, the image display devices will come one after another into sight of the person 20 moving along the path 10, a message displayed on each of the image display devices 50, 51, . . . , 5*n* can be viewed by the person 20 moving in each of viewable zones indicated as hatched in FIGS. 5 and 6 but the person 20, if moving outside the viewable zone, cannot see the message on the image display device. In this case, the controller 30 calculates a time (e1/v0) which will be taken for the person 20 moving at a velocity v0 to go over a distance between adjacent image display devices on which no images can be viewed by the person 20, for example, a distance e1 from a point at which an image on the image display device 50 goes out of sight of the person 20 to a point where an image on the image display device 51 comes into sight of the same person 20. The calculation can be expressed as follows:

$$Y10=Y00+e1/v0$$

That is to say, by delaying the transmission start time of the image display device 51 by the time calculated from the transmission start time Y00 of the image display device 50, the controller 30 has the image display device 51 continuously display a message of which the display has once been discontinued.

The controller 30 copies the playlist master PM to generate the playlists P0, P1, . . . , Pn for the image display devices 50, 51, . . . , 5*n*, respectively, and executes a series of calculation programs under which the transmission start points of time for the same events in the playlists P0, P1, . . . , Pn for the image display devices 50, 51, 5*n*, respectively, are delayed by e1/v0, e2/v0, . . . , en/v0, respectively, based on previously measured lengths e1, e2, . . . , en of the zones covered by the image display devices 50, 51, . . . , 5*n* in which the displayed images are not viewable and a assumed velocity v0 of the moving person 20, to thereby control the information display programs of the image servers 40, 41, . . . , 4*m* in accordance with the playlists P0, P1, . . . , Pn, respectively. Thus, by executing a series of calculation programs under which the transmission start points of time for the same events of the playlists P0, P1, . . . , Pn for the image display devices 50, 51, . . . , 5*n*, respectively, are delayed by e1/v0, e2/v0, . . . , en/v0, respectively, the controller 30 can control, based on the sole playlist master PM, the information display programs of the image servers 40, 41, . . . , 4*m* to have the image display devices 50, 51, . . . , 5*n* share with each other to display a series of information, each of the image display devices thus displaying a part of the series of information that is readily recognizable by the moving person 20.

The velocity of the moving person 20 is measured continuously by the velocity detector 60. If there is found a velocity larger than a preset one, the controller 30 will recalculate the transmission start time for the events after the velocity change has been detected, with the velocity v0 in the calculation program replaced with velocity information v1 measured by the velocity detector 60, thereby permitting to present a series of information to the moving person 20 continuously by means of the image display devices 50, 51, . . . , 5*n*.

Figure 7:
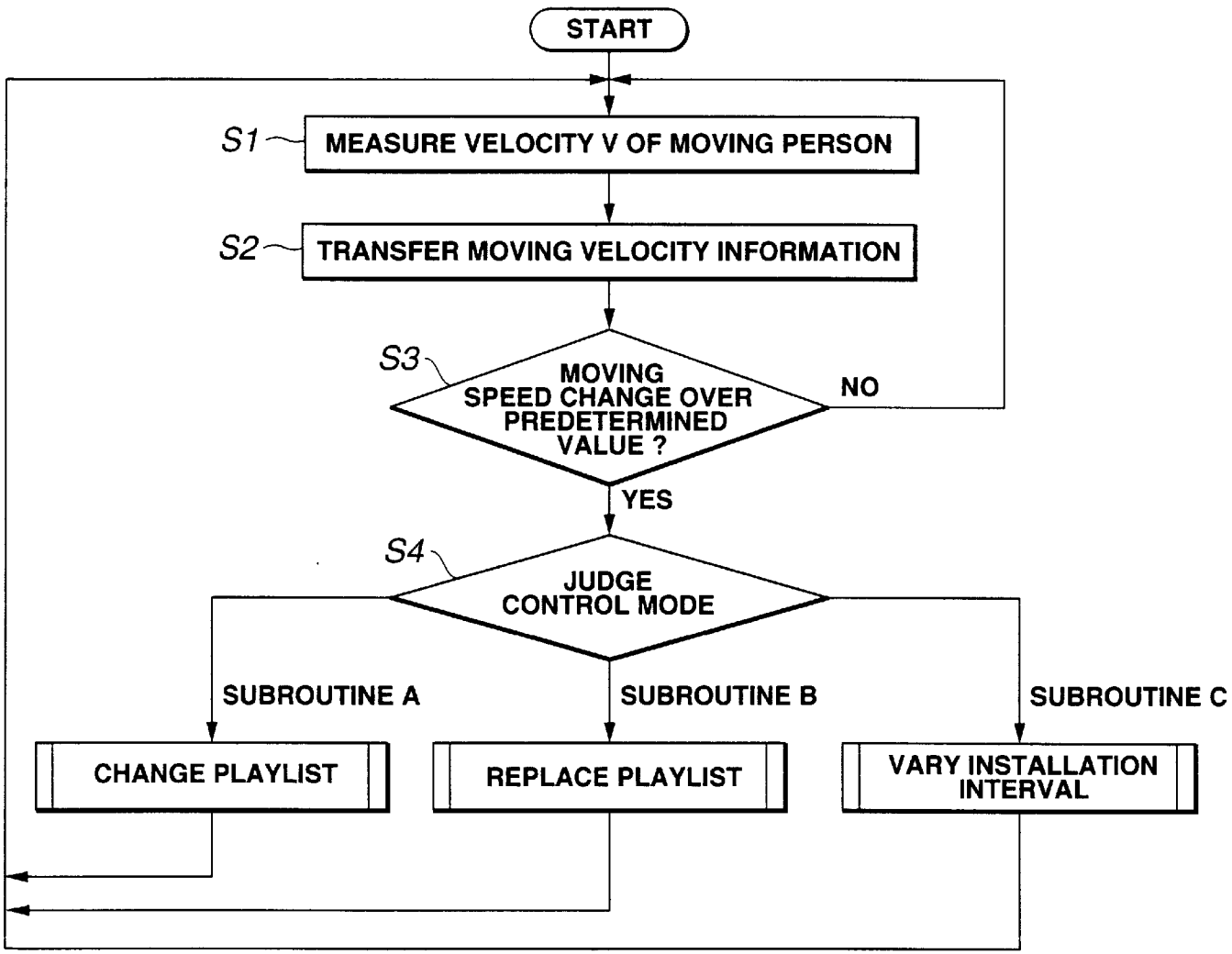
FIG. 7 is a flow chart of information displaying operations effected in the information display system.

In the information display system 100, information can be displayed by the operations shown in the flow chart shown in FIG. 7.

That is, the velocity of the person 20 moving along the path 10 is continuously measured by the velocity detector 60 (at step S1), and information ν thus obtained and indicating the velocity of the moving person 20 is transferred from the velocity detector 60 to the controller 30 (at step S2).

The controller 30 compares the velocity of the moving person 20 shown as the velocity information ν transferred from the velocity detector 60 with a previously measured velocity v0, and judges whether there has repeatedly occurred a velocity change larger than a predetermined one (at step S3). If a velocity change over the predetermined value is detected, the controller 30 will judge which the currently set control mode is (at step S4), and run a subprogram (subroutine A, B or C) for the control mode, thus sending a program for presentation to the moving person 20.

Figure 8:
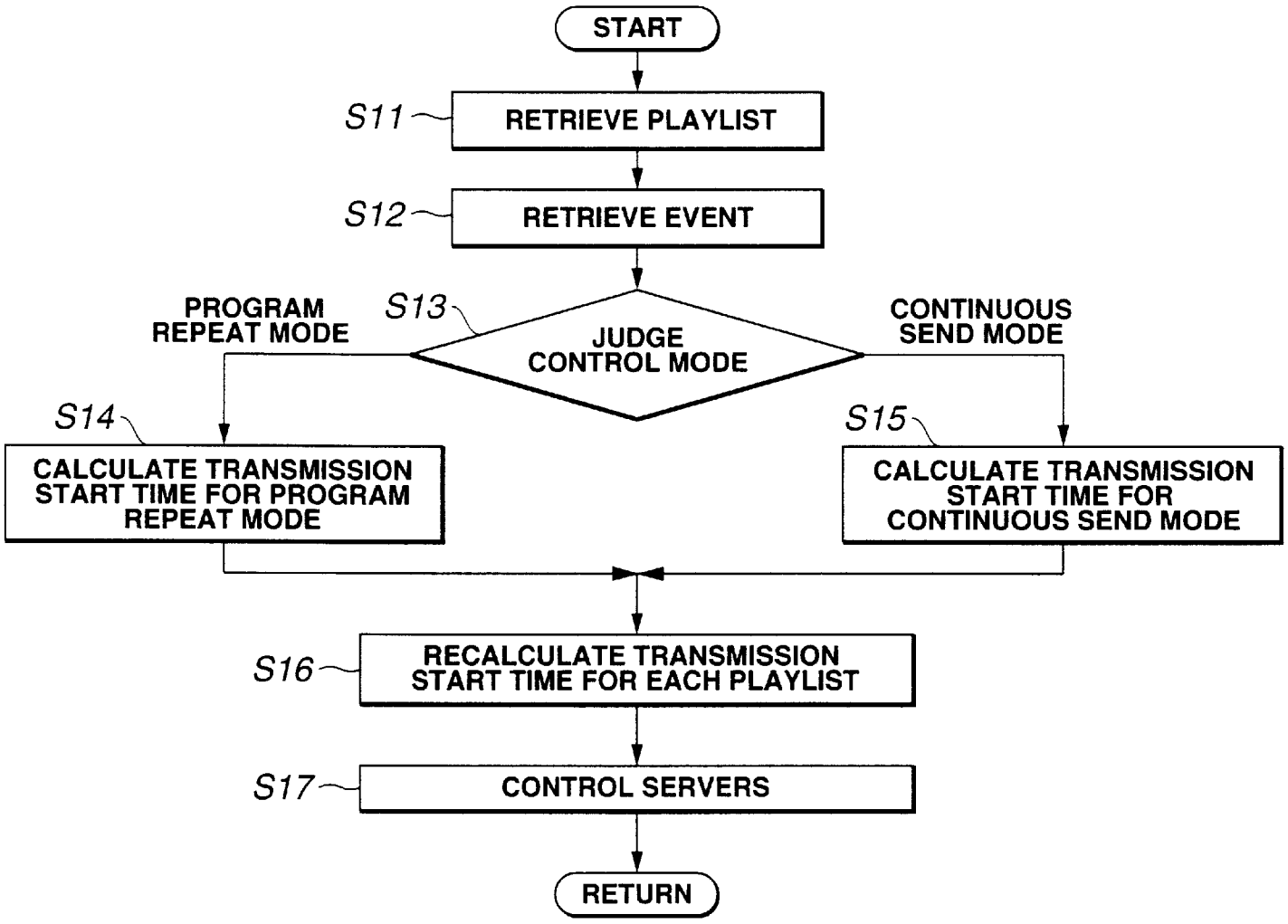
FIG. 8 is a flow chart of operations for changing program lists, effected by the controller.

When the subroutine A is put into run, the controller 30 will change the playlists as in the flow chart shown in FIG. 8.

First, a playlist for an image display device located at a position covering the person 20 whose velocity has changed to v1 is retrieved from the playlists P0, P1, . . . , Pn (at step S11). For the convenience of the illustration and description of the present invention, it is assumed herein that the playlist P0 for the image display device 50, for example, is retrieved.

Next, an event which has been under execution when the velocity change was detected, for example, the Event 0, is retrieved (at step S12).

Then, it is judged (at step S13) which is set up, a program repeat mode or a continuous send mode.

In case the control mode has been set up is the program repeat mode, since the moving velocity V0 of the person 20 has changed to v1, the time d1/v0+e1/v0 for which the same image is repeatedly displayed on the image display device at a distance d1 even after the person 20 has passed through the zone where no image can be viewed by the person 20, is changed from v0 to v1 to calculate the transmission start points of time Y11 to Y1q for the Events 1 to q in the playlist P0 (at step S14).

In case the continuous send mode is set up, since the moving velocity of the person 20 has changed from v0 to v1, the time in which the person 20 passes through the zone in which no image can be viewed from the person 20 is changed from e1/v0 to e1/v1 to calculate the transmission start points of time Y11 to Y1q for the Events 1 to q in the playlist P1 (at step S15).

There is calculated (at step S16) each of the transmission start points of time of the playlists P1, P2, . . . , Pn for the series of display devices 51, 52, . . . , 5*n* corresponding to the transmission start points of time Y11 to Y1q, respectively, for the Events 1 to q, respectively, in the playlist P1.

Then, based on the changed playlists P1, P2, . . . , Pn, the information display programs of the image servers 41, 42, . . . , 4*m* are controlled (at step S17).

Figure 9:
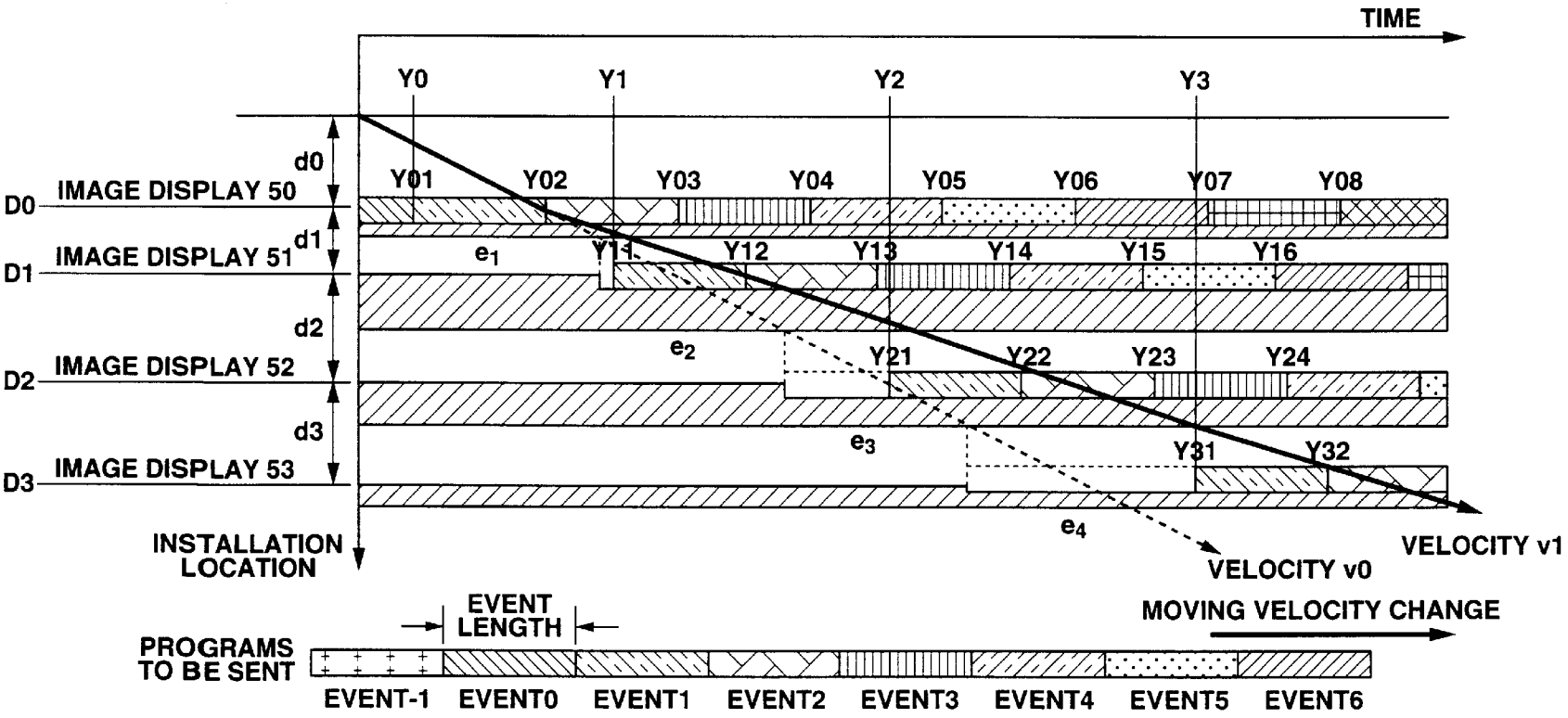
FIG. 9 schematically shows an example of the relationship between information contents displayed by the image display devices and playlists when in the program repeat mode of the information display system.

In case the pro grain repeat mode is currently set up, the playlists P0, P1, . . . . , Pn as shown in FIG. 3 are generated to control the information display programs of the image servers 40, 41, . . . 4*m*. Thereby, the Event 2, for example, can repeatedly be presented to the moving person 20 as will be seen from the relationship between the information contents displayed by the image display devices 50, 51, . . . , 5*n* and playlists as shown in FIG. 9.

Figure 10:
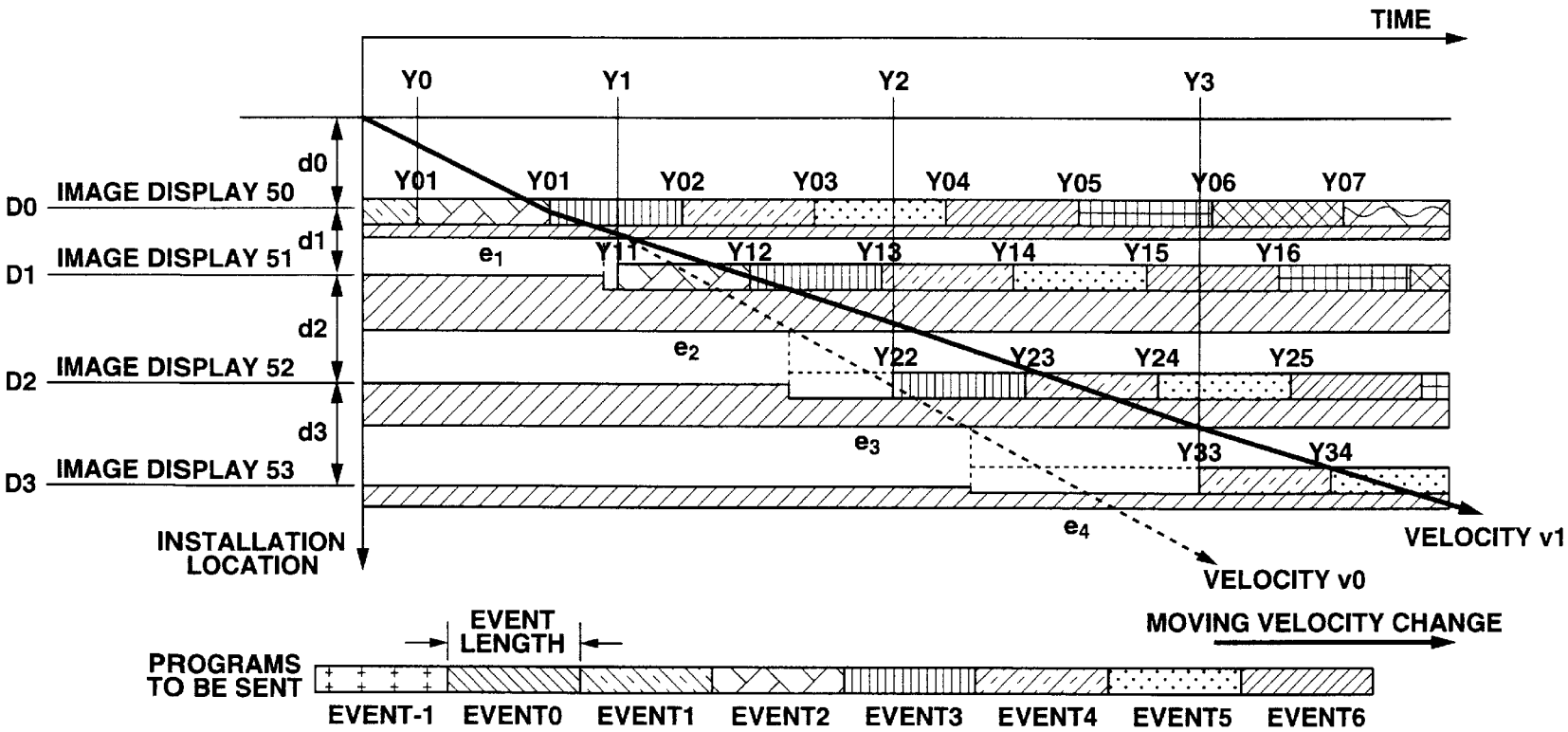
FIG. 10 is a schematic view of an example of the relationship between information contents displayed by the image display devices and playlists when in the continuous send mode of the information display system.

In case the continuous send mode is currently set up, the playlists P0, P1, . . . , Pn as shown in FIG.4 are generated to control the information display programs of the image servers 41, 42, . . . , 4*m*. Thus, the Events 0, 1, . . . , q are serially presented in this order to the moving person 20 as shown in FIG. 10 showing the relationship between the information contents displayed by the image display devices 50, 51, . . . , 5*n* and playlists.

Figure 11:
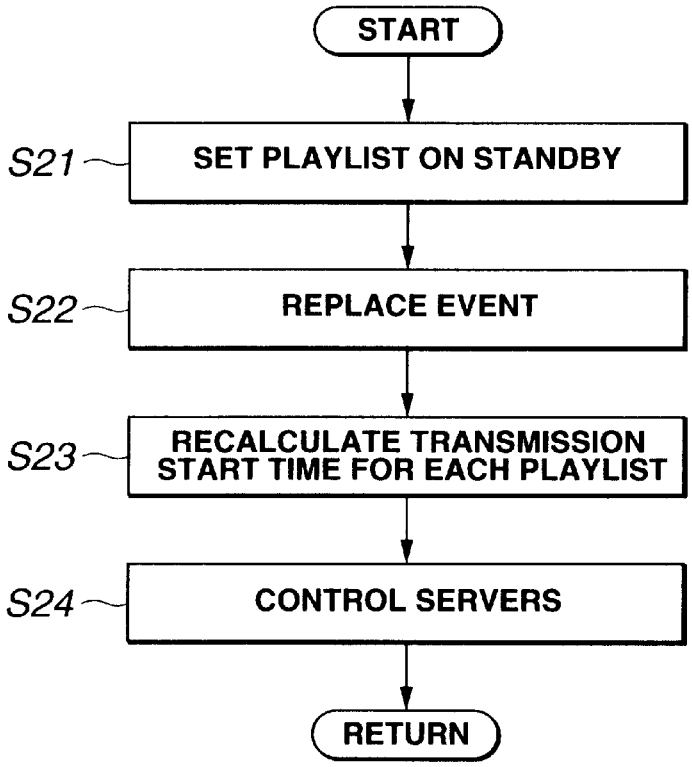
FIG. 11 is a flow chart of operations for replacing one of the playlists with to another, made by the controller.

When the subroutine B is put into run, the controller 30 will replace the playlists as in the flow chart shown in FIG. 11.

That is, the controller 30 will put into the standby state a playlist PL1 previously generated for each velocity range of the moving person (at step S21).

At the transmission start time for the event (Event 1) in the playlist PL1 and subsequently after the velocity of the moving person 20 has changed to v1, the events are replaced with the Event 1 in the playlist PL1 (step 22).

There is calculated (at step S23) each of the transmission start points of time in the playlists P1, P2, . . . , Pn for the series of display devices 51, 52, . . . , 5*n* corresponding to the transmission start points of time, respectively, for the Events 1 to n, respectively, in the playlist PL1.

Then, based on the changed playlists P1, P2, . . . , Pn, the information display programs of the image servers 41, 42, . . . , 4*m* are controlled (at step S24).

Figure 12:
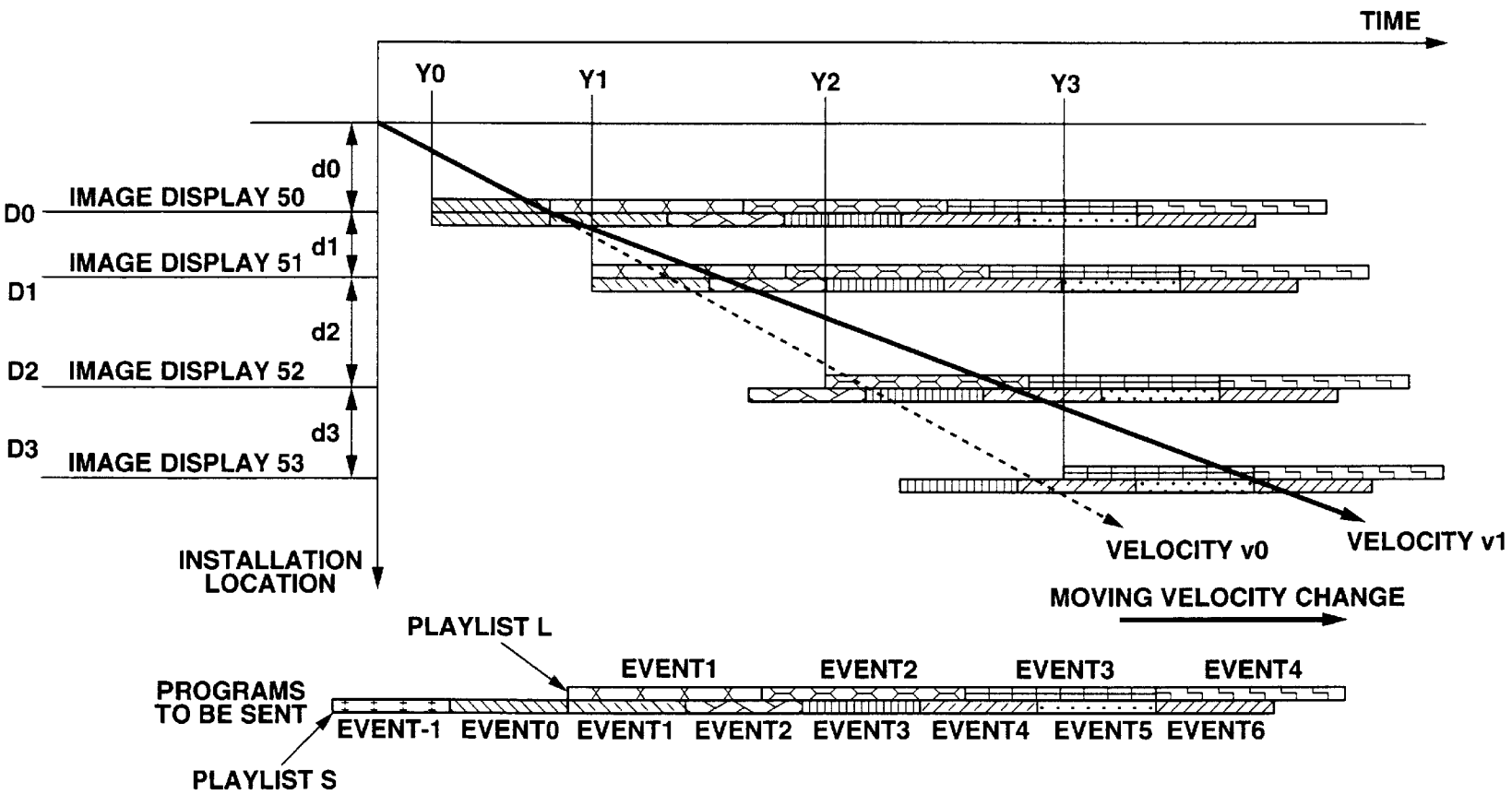
FIG. 12 is a schematic view of an example of the relationship between information content displayed by the image display devices and playlist when one of the playlists is replaced with another by the controller.

Thus, programs (Event 0, 1, . . . , q) can be presented serially in this order to the moving person 20 by using the playlist PL1 suitable for the installation intervals d1, d2, . . . , dn of the image display devices 50, 51, . . . , 5*n* in accordance with the velocity of the moving person 20, as shown in FIG. 12 indicating the relationship between information display contents by the image display devices 50, 51, . . . , 5*n* and playlists.

Figure 13:
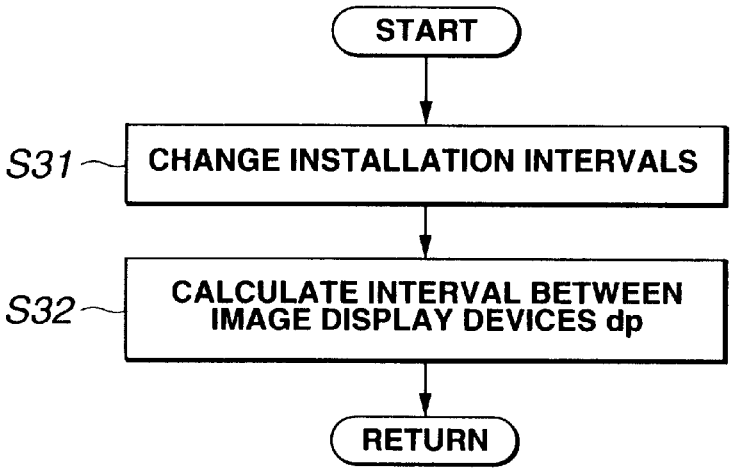
FIG. 13 is a flow chart of operations for varying the interval between the image display devices, made by the controller.

When the subroutine C is put into run, the installation intervals d1, .2 . . . ., dn of the image display devices 50, 51, . . . , 5*n* are changed by the controller 30 as shown in the flow chart in FIG. 13 (at step S31).

That is, an installation interval dp is calculated as follows:

$$dp = v1 \times x$$

where x is a time for which a program is to be displayed on one image display device, and v1 is a velocity of the moving person 20 (at step S32).

The image display devices 51, 52, . . . , 5*n* are displaced for the space between two successive ones thereof to be dp.

Figure 14:
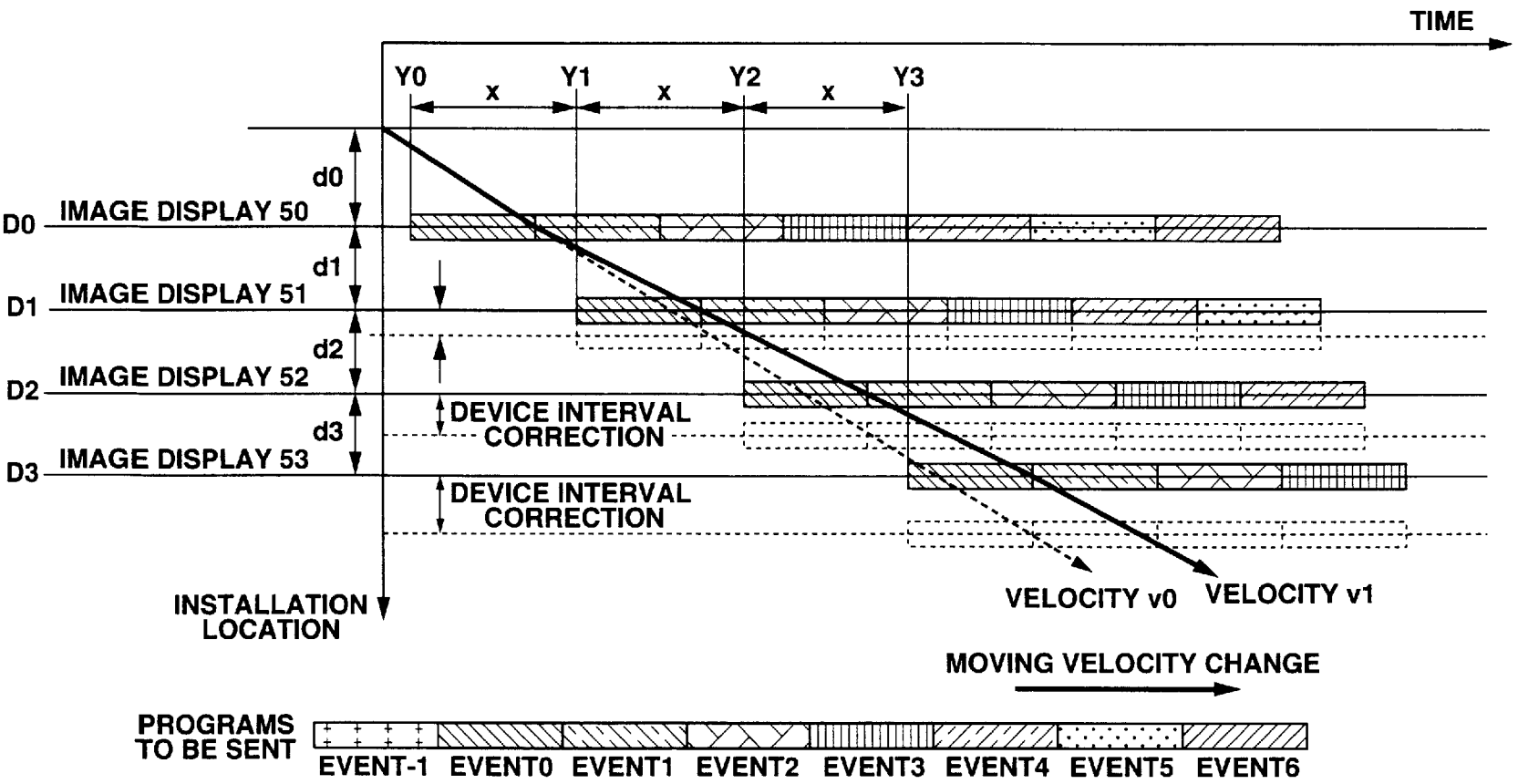
FIG. 14 is a schematic view of an example of the relationship between information contents displayed by the image display devices and playlists when the interval between the image display devices is varied by the controller.
Figure 15:
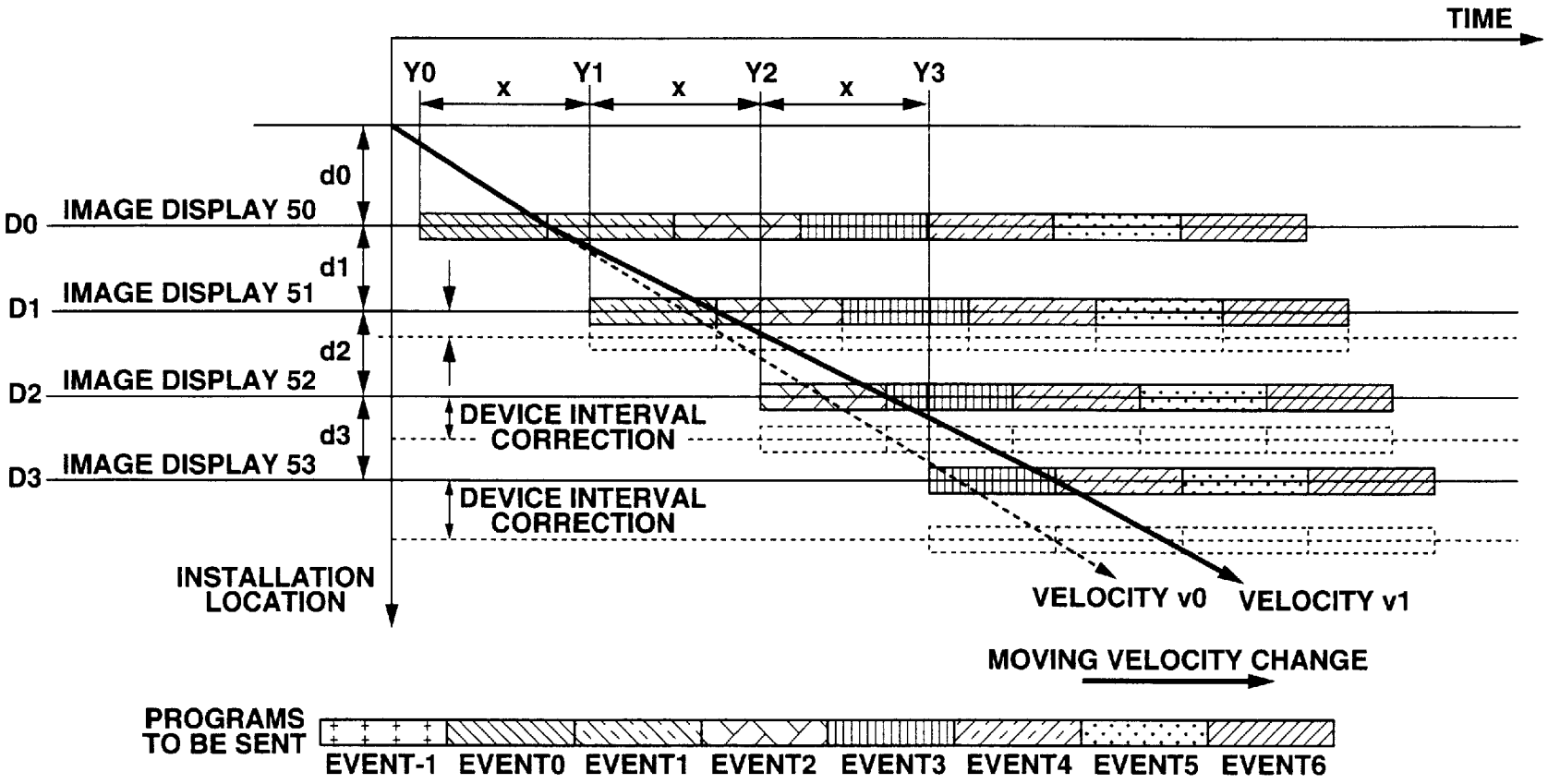
FIG. 15 is a schematic view of another example of the relationship between information contents displayed by the image display devices and playlists when the interval between the image display devices is varied by the controller.

By changing the installation intervals of the image display devices 51, 52, . . . , 5*n* while the subroutine C is being executed, it becomes possible to repeatedly transmit the Event0 to the moving person 20 as shown in FIG. 14, which indicates the relationship between information contents displayed on the image display devices 50, 51, . . . , 5*n* and playlists, or to serially transmit the Event 0, 1, . . . , q in this order to the moving person 20, as shown in FIG. 15, which indicates the relationship between information contents displayed on the image display devices 50, 51, . . . , 5*n* and playlists.

In the information display system 100, the information display programs of the image servers 40, 41, . . . , 4*m* are automatically controlled by the controller 30 by transferring to the controller 30 the velocity information v indicating a velocity of the moving person 20 from the velocity detector 60 adapted, as previously described, to detect a velocity of the person 20 moving along the path 10. Otherwise, the velocity information v indicating a velocity of the moving person 20 may be manually supplied to the controller 30, or an empirical velocity of such moving person may be employed as the velocity information v.

The information display system 100 employs a number m of image servers 40, 41, . . . , 4*m* which can store message materials in the storage units thereof while transmitting different program materials, which may contain more than one same material, over a number g of channels from the transmitters. However, a number n of VTRs or video disc players controlled by the controller 30 may be substituted for the number m of image servers 40, 41, . . . , 4*m* to provide the image display devices 50, 51, . . . , 5*n* with message materials.

Furthermore, a personal computer having communication facility may be adopted in place of the number n of VTRs or video disc players to provide the image display devices 50, 51, . . . , 5*n* with message materials transmitted via Internet under the information display programs controlled by the controller 30.

While the present invention has been described with reference to specific embodiments chosen for purpose of illustration. It should be apparent that numerous modifications could be made thereto by those skilled in the art without departing from the basic concept and scope of the present invention.

What is claimed is:

1. An information display system comprising:

a plurality of information display means arranged one after another along a predetermined path for persons to whom the information is to be presented;

an information sending means for sending information to the plurality of information display means under an information display program; and a control means for controlling the information display program of the information sending means in accordance with a velocity of the person moving along the path;

the information display means sharing with each other in displaying a series of information under the information display program, each being adapted to display a part of the series of information that is readily recognizable by the moving person.

2. The information display system as set forth in claim 1, further comprising:

a velocity detection means for detecting the velocity of the moving person;

the control means controlling the information display program of the information sending means in accordance with the velocity of the moving person detected by the velocity detection means.

3. The information display system as set forth in claim 2, further comprising:

an installation interval control means for varying the installation intervals of the information display means in accordance with the velocity of the moving person detected by the velocity detection means;

the information display program control means controlling the information display program of the information sending means in accordance with the installation intervals of the information display means varied by the installation interval control means and velocity of the moving person detected by the velocity detection means.

4. The information display system as set forth in claim 1, wherein the information sending means has an information storage means for storing information to be displayed, and sends the information stored in the information storage means according to the information display program.

5. The information display system as set forth in claim 4, wherein the plurality of information display means is divided into a plurality of groups each supplied with the information from the information sending means provided for each group.

6. The information display system as set forth in claim 1, wherein the information sending means send the information provided via a communication line to the information display means under the information display program.

7. An information display method including the steps of:

detecting the velocity of a person moving along a predetermined path along which a plurality of display means is arranged one after another;

controlling an information display program in accordance with the detected velocity of the moving person; and displaying, under the information display program, a series of information by the plurality of information display means sharing with each other in the displaying, each of the information display means being adapted to display a part of the series of information that is readily recognizable by the moving person.

8. The information display method as set forth in claim 7, wherein the velocity of the moving person is detected, and the information display program is controlled based on velocity information which indicates the detected velocity.

9. The information display method as set forth in claim 7, wherein a series of information is divided in accordance with the velocity of the moving person for sequential display on the information display means.

10. The information display method as set forth in claim 7, wherein a series of information is displayed repeatedly on the information display means.

11. The information display method as set forth in claim 7, wherein installation intervals of the information display means are varied in accordance with the velocity of the moving person, and the information display means share with each other in displaying a series of information under the information display program, each being adapted to display a part of the series of information that is readily recognizable by the moving person.

* * * * *